US006869493B2

(12) United States Patent
Tsai

(10) Patent No.: US 6,869,493 B2
(45) Date of Patent: Mar. 22, 2005

(54) APPARATUS FOR MANUFACTURING WIRE

(76) Inventor: Cheng-Lang Tsai, No. 38, Lane 196, Kwangfu Rd., Sec. 2, San Chung City, Taipei Hsien (TW)

( * ) Notice: Subject to any disclaimer, the term of this patent is extended or adjusted under 35 U.S.C. 154(b) by 360 days.

(21) Appl. No.: 10/155,064

(22) Filed: May 28, 2002

(65) Prior Publication Data

US 2003/0221786 A1 Dec. 4, 2003

(51) Int. Cl.[7] ..... B65H 81/00

(52) U.S. Cl. ..... 156/148; 156/51; 156/52; 156/53; 156/428; 57/18

(58) Field of Search ..... 156/428, 148, 156/51, 52, 53; 57/18

(56) References Cited

U.S. PATENT DOCUMENTS 1,531,361 A * 3/1925 Varillon et al. ..... 57/18
2,220,006 A * 10/1940 Walsh et al. ..... 57/18
3,124,924 A * 3/1964 Smith ..... 57/18
3,425,209 A * 2/1969 Goy ..... 57/18
3,668,857 A * 6/1972 Goy et al. ..... 57/18
6,727,433 B2 * 4/2004 Tsai ..... 174/110 R

OTHER PUBLICATIONS

Abstract of South African Patent 200002698 published Jan. 31, 2001.*

* cited by examiner

*Primary Examiner*—Jeff H. Aftergut
(74) *Attorney, Agent, or Firm*—Bacon & Thomas, PLLC

(57) ABSTRACT

The present invention relates to an apparatus for manufacturing wire having an inverted cone-shaped cylinder within a spool, wherein the diameter of the top end of the cylinder is larger than the lower end thereof enabling a tape wound thereon unwound from the spool to go from a lower position to a higher position of the cylinder while the tape being wrapped on the wire due to the centrifugal force of rotation in the wrapping process. This has the benefit of preventing the subsequent turns of the tape from loosening out of the spool, and enables the tape being continuously, evenly, and securely wrapped on the wire in a high speed operation.

6 Claims, 7 Drawing Sheets

APPARATUS FOR MANUFACTURING WIRE

FIELD OF THE INVENTION

The present invention relates to wire manufacturing and more particularly to an apparatus for manufacturing wire including electrical wire, cable, cord, and wire for manufacturing handicraft or other decorative articles.

BACKGROUND OF THE INVENTION

Conventionally, the method for manufacturing electrical wire utilizes an extrusion manufacturing process to extrude an opaque plastic material uniformly onto the surface of a plurality of electrical wires, each of the wires surrounded with an insulating medium, to form a uniform outer protection layer with better insulation. As to the method for manufacturing colored wire, it is merely by adding dye into the plastic material in the process to produce the color wanted. The color obtained by utilizing the conventional technique is monotonous or irregular, which is unable to let the wire present a variety sparkling color.

As to those conventional wires used for manufacturing handicraft or other decorative articles, they are generally classified as soft wire and hard wire depending on their hardness. Typically, soft wire is formed of stranded color filaments by using a conventional manufacturing process, which is tedious and labor consuming. This kind of soft wire is easy to be dirtied, but not easy to be cleaned, and the color thereof will easily fade away. Moreover, the soft wire is limited in applications since there is no support member, such as rigid metal or non-metal material, being inserted in the wire. Hence, wire manufacturers in the art implemented the conventional method as stated above to manufacture the wire having a metal or non-metal support member therein by utilizing an extrusion manufacturing process to extrude an opaque plastic material uniformly onto the surface of the metal or non-metal support member. As a result, the wire may also have color by adding dye into the plastic material in the extrusion manufacturing process. However, the wire can only present monotonous and irregular color, but not sparkling and variety colors.

Currently, a thread winding method is utilized in manufacturing electrical wire. The method comprises winding a cotton thread or the like on the surface of stranded electrical wires to tie them together in a uniform shape, and extruding an opaque plastic material uniformly onto the surface of the wound electrical wires to form a uniform outer protection layer with better insulation. Such method is embodied in an apparatus as illustrated in FIG. 1. The apparatus comprises a machine frame 80 provided thereon a hollow rotation seat 13, a belt 16, and a drive device 81 together with the rotation seat 13 and belt 16 to form a chain drive. Further, an upright hollow shaft 14 is fixedly coupled to the center of the rotation seat 13. While the rotation seat 13 rotates as the drive device 81 activates the running of the belt 16, the hollow shaft 14 rotates simultaneously. Furthermore, the apparatus comprises a spool 15 having a hollow cylinder 153 as its rotation shaft and a rim 152 at either end, where thread 10 formed of cotton or the like is wound on the cylinder 153 between the rims 152.

As shown in FIG. 1, while winding the thread 10 on at least one wire 12, the process comprises the steps of putting the hollow cylinder 153 of the spool 15 onto the hollow shaft 14 with the rim 152 rested on the rotation seat 13, threading the wire 12 through the rotation seat 13 and the hollow shaft 14 from the bottom of the rotation seat 13, pulling the wire 12 from the above of the hollow shaft 14 to one or more cylinders of a take-up device 82, winding one end of the thread 10 around the wire 12 above the hollow shaft 14, and activating the drive device 81 and take-up device 82 for turning the spool 15 and keeping on pulling the wire 12. At this moment, the thread 10 is thereby unwound from the spool 15 due to the centrifugal force of rotation, and sequentially wound on the wire 12.

In view of the above, since the thread 10 is made of stranded cotton or other fiber, a predetermined tension and friction exist among the adjacent turns of the thread 10 wound on the spool 15 due to the interactive friction forces between the fibers thereof. When the spool 15 rotates, the thread 10 is unwound from the spool 15 due to the centrifugal force of rotation, and sequentially wound on the wire 12. At the same moment, the interactive friction forces between the fibers of the adjacent turns of the thread 10 enable the subsequent turns of the thread 10 still wound on the spool 15, without loosening from the spool 15. Therefore, the outer diameters of the hollow cylinder 151 from top to bottom can be the same in order for the thread 10 to be evenly wound on the cylinder 151 of the spool 15.

However, while winding fine thread with light weight on the wire by using the above winding method, the thread may become loosened due to no sufficient tension existing therein caused by air friction, which prohibits the thread from being tightly wound on the wire. Subsequently, the turns of thread wound thereon may become disengaged from the wire in a subsequent extrusion process due to the compression force of the extrusion. The disengaged turns of thread will be easily entangled together and may adversely affect the quality of forming a cable having a uniform outer layer. A solution to the above problem is proposed by putting a flywheel 27 on the hollow shaft 24 above the top of the spool 25, as illustrated in FIG. 2, wherein the flywheel 27 is formed of a bent steel rod and comprises a central hole 273, two arms 272 extended outward in opposite directions, and two eyes 271 each formed at the open end of the arm 272. While winding the fine thread 20 on the wire 22, the process further comprises the steps of threading the thread 20 through the eye 271 prior to winding the thread 20 on the wire 22, and activating the drive device and take-up device (both not shown) to rotate the spool 25 and thus the flywheel 27. The rotating speed of the flywheel 27 will be slightly higher than that of the spool 25, after a short period of time of operation, due to the inertia of the flywheel 27. At this moment, the flywheel 27 will apply a predetermined force (i.e., tension) on the thread 20 unwound from the spool 25 due to the centrifugal force of rotation. As a result, the unwound thread 20 is sequentially and tightly wound on the wire 22.

As to the strong thread with heavy weight, a relatively large tension is required to exert on the thread while winding the thread on the spool. As such, the thread tends to become tightly wound on the spool, resulting in increasing the interactive friction between the adjacent turns of thread. This may cause the thread difficult to be unwound from the spool for being subsequently wound on the wire in the manufacturing process. In a worse condition, the thread may break due to the large tension therein during winding, which will eventually impede the winding progress. A solution to the above problem is detailed in FIG. 3, wherein the spool 35 is configured to have a cone-shaped cylinder 351. A line from the top periphery to the bottom one of the cylinder 351 is at an angle of $\alpha$ with respect to a vertical line, which will make the diameter of the top end of the cylinder 351 smaller than that of the lower end. As contemplated, the unwound thread will go from a lower position of the cylinder having a larger diameter, as indicated by numeral 302, to a higher position of the cylinder having a smaller diameter, as indicated by numeral 301, prior to being wound on the wire 32 in the manufacturing process, which will suitably release the tension existing therein gradually. Thus, the thread unwound from the spool 35 may not become entangled with the adjacent turns. As a result, the thread will be more easily and smoothly wound on the wire 32.

Since the thread is made of stranded cotton or other fiber, the tension and friction existing among turns of the thread wound on the spool, due to the interactive friction between the fibers thereof, will prohibit the subsequent turns of the thread wound on the spool from loosening out of the spool while winding the thread on the wire. However, winding a flat, light, smooth and flexible tape 400, such as a color tape formed of Mylar coated with metal film, on the spool 45, as illustrated in FIG. 4 will cause the following problems because the interactive friction between the turns of tape 400 wound on the spool is completely different from that of the conventional thread:

(1) A predetermined tension must be applied on the tape 400 while winding the tape 400 on the spool 45, which will make the tape 400 being tightly wound on the spool 45. However, in utilizing any of the above prior arts in wrapping the tape 400 on the wire 42, the tension released by a turn of the tape 400 unwound from the spool 45 prior to being wrapped on the wire 42 may exert on the subsequent turns of the tape 401, 402, and 403. As such, the turns 401, 402, and 403 tend to disengage from the spool 45 due to little friction existing among them, and entangle together. The entangled turns 402 and 403 (see FIG. 4) will be subject to breakage while a pulling force is exerted thereon. This will apparently low down the performance of manufacturing high quality wire, especially in mass production.

(2) Typically, in order to permit the flywheel 47 to rotate freely, a tolerance F is provided between the hollow shaft 46 (after the flywheel 47 being put thereon) and a nut 43 secured on one end of the hollow shaft 46 above the flywheel 47, wherein a fixed distance H from the top of the nut 43 to the top of the rim 451 of the spool 45 is maintained. Such distance H will increase the angle β of the tape 400 at a section from the wire 42 to the eye 471 of the flywheel 47 with respect to the top surface of the flywheel 47. Thus, the tape 400 wrapped on the wire 42 may easily become not even and cause the subsequent turns of the tape 400 wrapped on the wire 42 wrinkled (48), as illustrated in FIG. 5, which will manufacture undesired cable with uneven surface.

(3) However, if the angle β of the tape 400 at a section from the wire 42 to the eye 471 of the flywheel 47 with respect to the flywheel 47 (i.e., wrapping angle) is too small, it may cause the lower edge of the tape 400 to rub the nut 43 and let the tape 400 be easily broken in a high speed operation, thus interrupting the manufacturing process.

(4) Finally, in an undesired condition, the tape 400 at a section from leaving the spool 45 to the eye 471 of the flywheel 47 may rub the edge of the rim 451 and let the tape 400 be easily broken in a high speed operation.

In this regard, it is inappropriate to utilize the conventional winding method to wrap the flat, light, smooth and flexible tape 400 on the wire 42 in a fast way to obtain a smooth and even surface wrapped on the wire 42. That is the reason why a variety of novel, colorful tape materials or tapes coated with metal film are still unable to be applied to the wire manufacturing. Thus, improvement exists in order to overcome the above drawbacks of prior art.

SUMMARY OF THE INVENTION

It is therefore an object of the present invention to provide an apparatus for manufacturing wire wherein at least one flexible tape is obliquely, evenly, and securely wrapped on at least one wire with two adjacent turns of the tape being partially overlapped.

In one aspect of the present invention, a spool of the apparatus is configured to have an inverted cone-shaped cylinder of which the diameter of the top end thereof is larger than the lower end to form an angle between the line from the bottom periphery to the top of the cylinder and a vertical line. Hence, the angle enables the tape unwound from the spool to go from a lower position of the cylinder having a small diameter to a higher position of the cylinder having a large diameter while the tape being wrapped on the wire due to the centrifugal force of rotation in the wrapping process. This has the benefit of progressively releasing the tension existing in the turns of tape wound on the spool and preventing the subsequent turns of the tape from loosening out of the spool, due to the suddenly released tension, and from entangling together. As a result, the tape can be continuously, evenly, and securely wrapped on the upward feeding wire in a high speed operation.

Another aspect of the present invention is to provide a flywheel including a central hole sleeved on the hollow shaft, two arms extended outward in opposite directions, two bifurcated ends each having side pieces, and four eyes each disposed at the open end of the side piece. While wrapping the tape on the wire, the process comprises threading one end of the tape through the lower and the upper eyes at one end of the flywheel, wrapping one end of the tape on the wire above the hollow shaft, activating the drive means and the take-up means to rotate the spool, unwinding the tape from the spool by utilizing the centrifugal force of rotation, and continuously wrapping the tape on the wire.

In still another aspect of the present invention, an angle of the tape at a section from the bifurcated end to the wire with respect to the wire has a predetermined value for preventing the tape from rubbing the nut after leaving the bifurcated end.

In a further aspect of the present invention, an angle of the bifurcated end has a predetermined value for preventing the tape from rubbing the rim of the spool after leaving the spool.

The above and other objects, features and advantages of the present invention will become apparent from the following detailed description taken with the accompanying drawings.

DETAILED DESCRIPTION OF THE PREFERRED EMBODIMENTS

Figure 1:
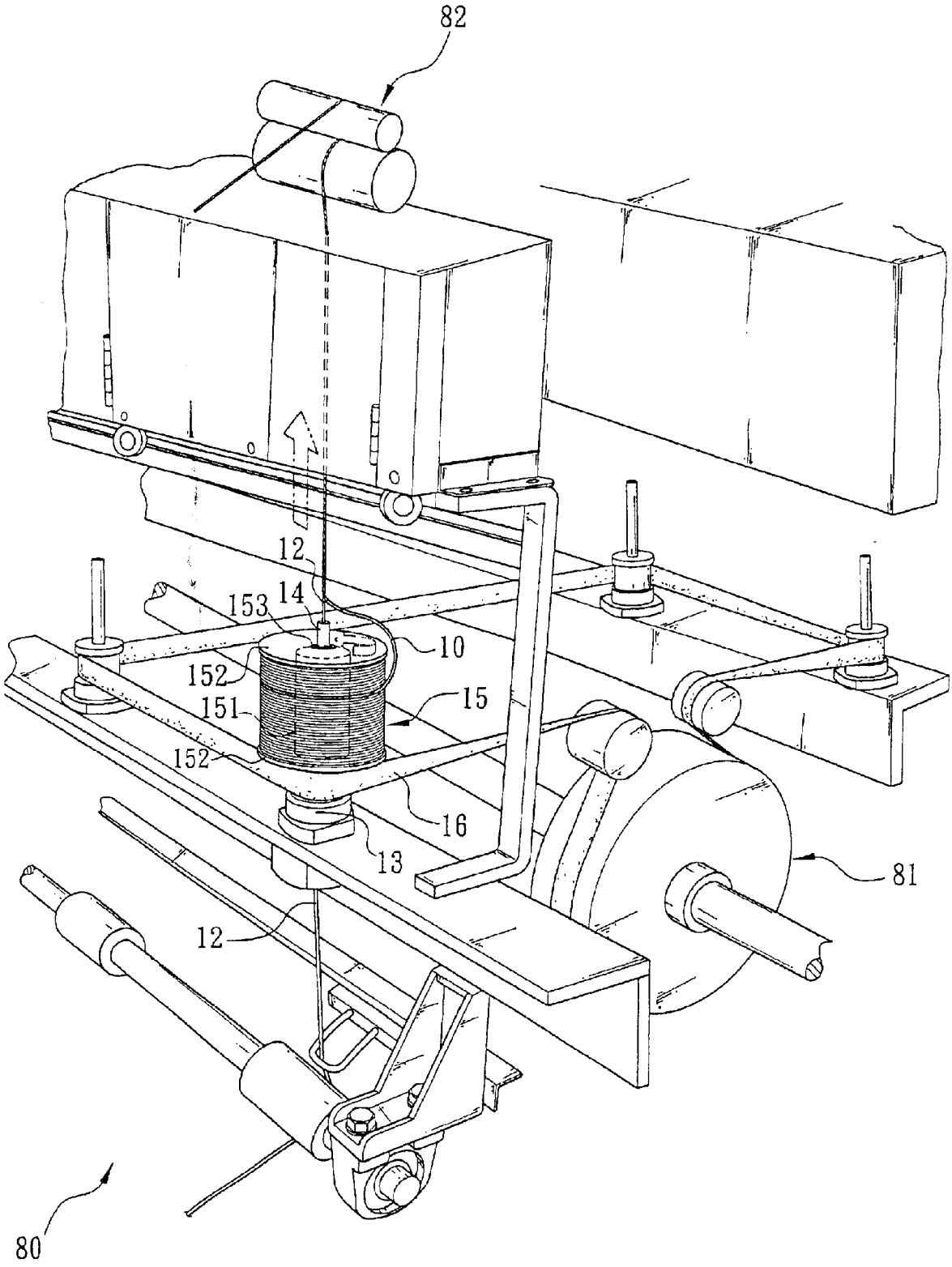
FIG. 1 (Prior Art)
FIG. 1 is a perspective view of a conventional apparatus for manufacturing wire.
Figure 2:
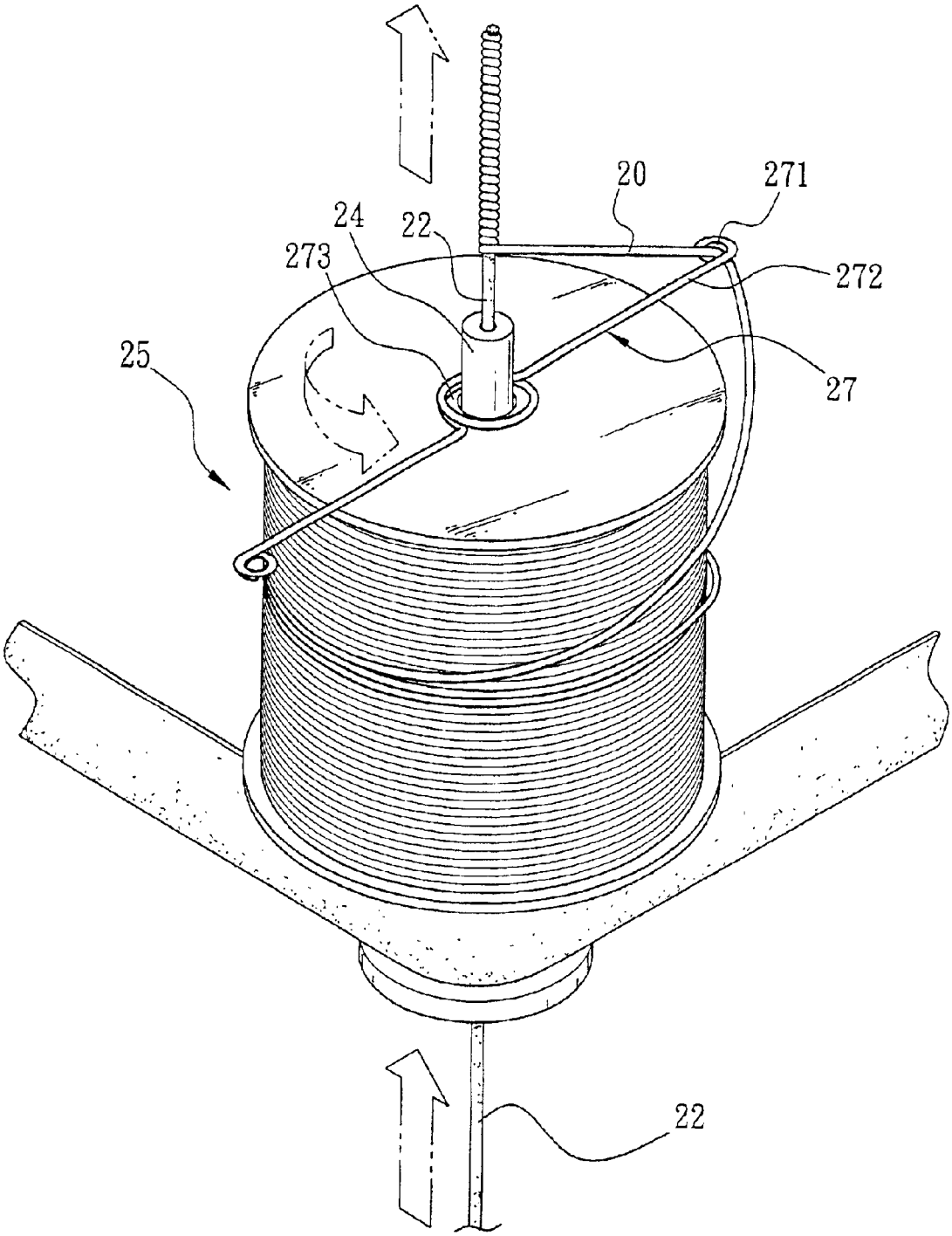
FIG. 2 (Prior Art)
FIG. 2 is a perspective view of another spool device incorporated in the conventional wire manufacturing apparatus.
Figure 3:
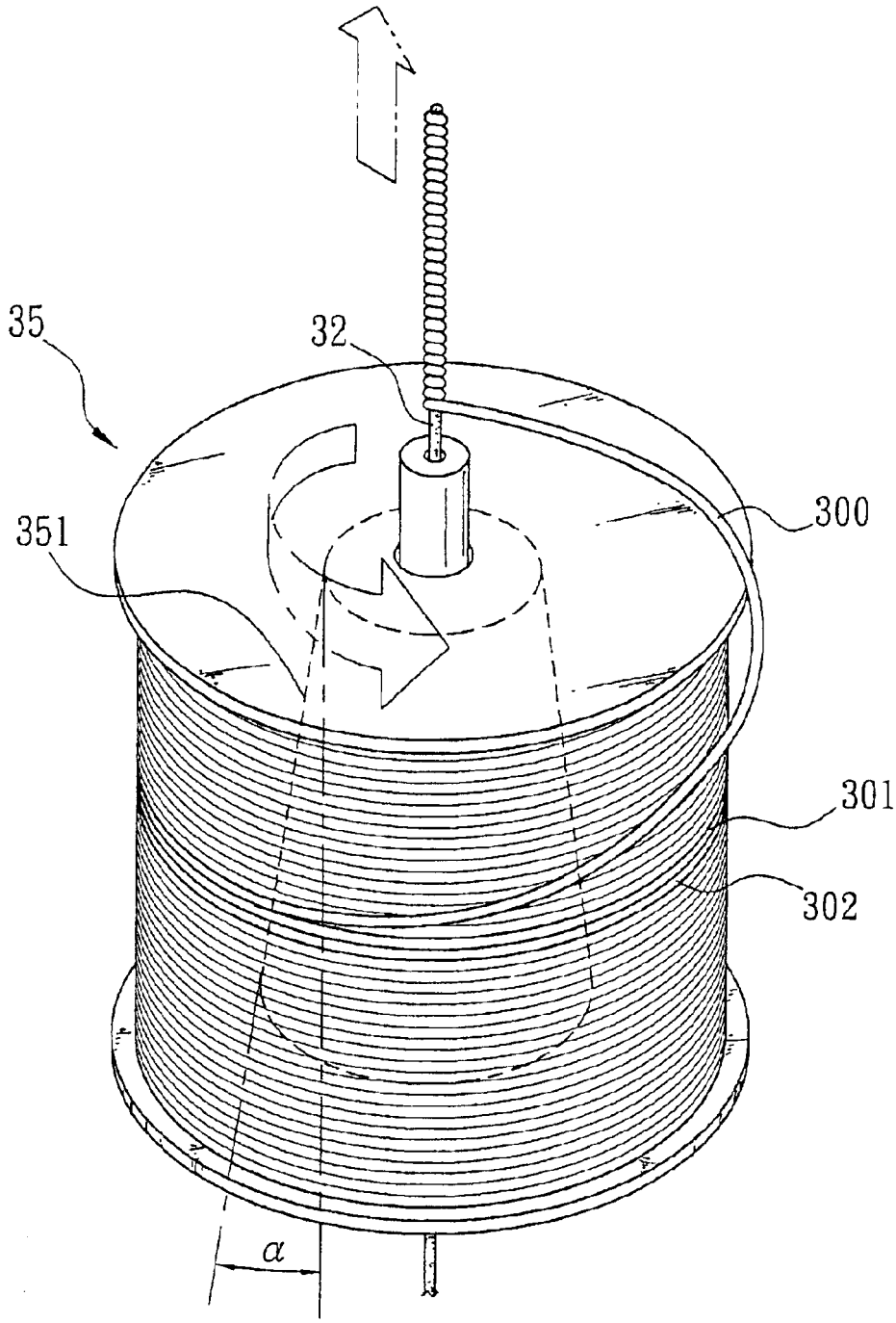
FIG. 3 (Prior Art)
FIG. 3 is a perspective view of still another spool device incorporated in the conventional wire manufacturing apparatus.
Figure 4:
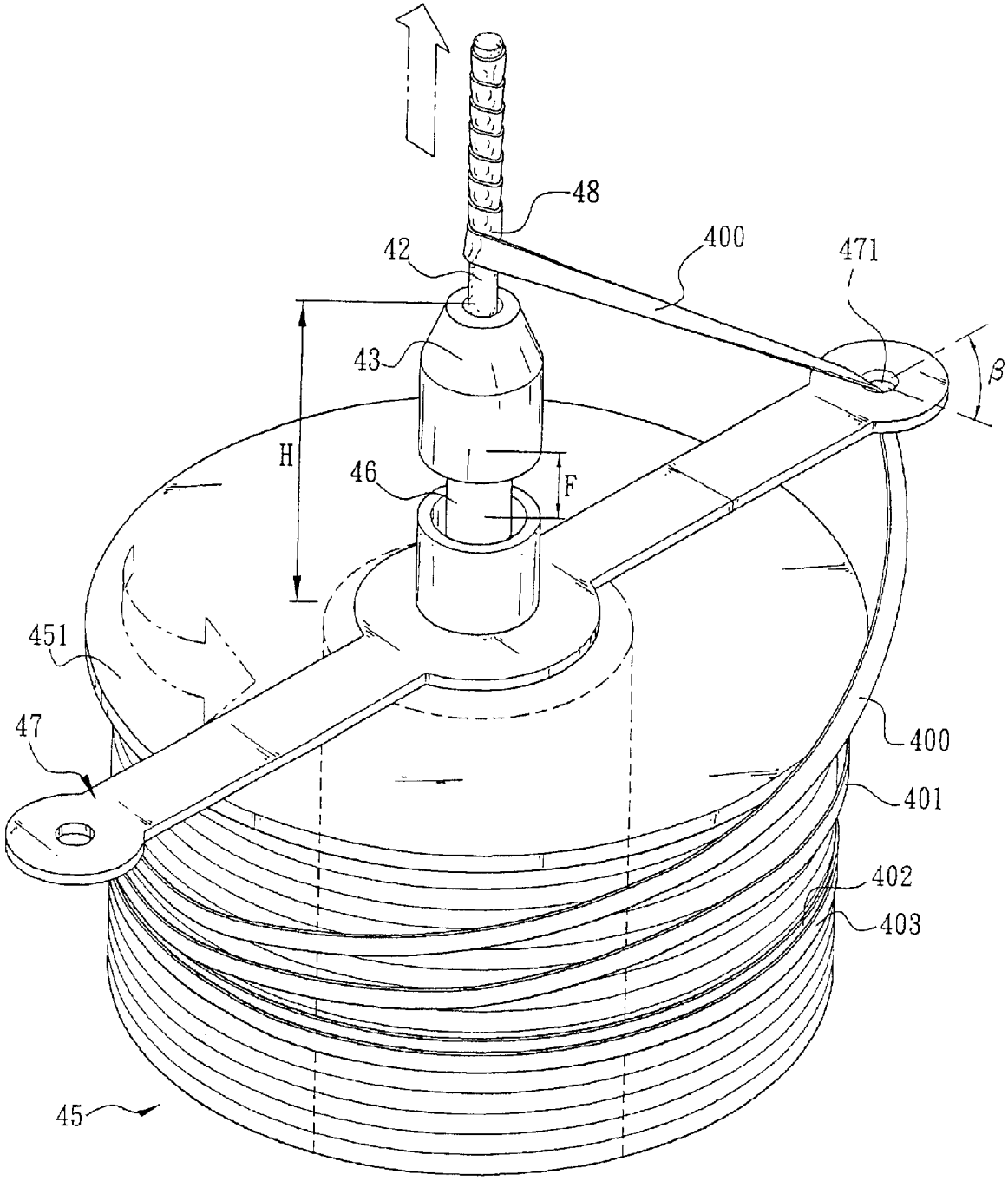
FIG. 4 (Prior Art)
FIG. 4 is a perspective view of a further spool device incorporated in the conventional wire manufacturing apparatus.
Figure 5:
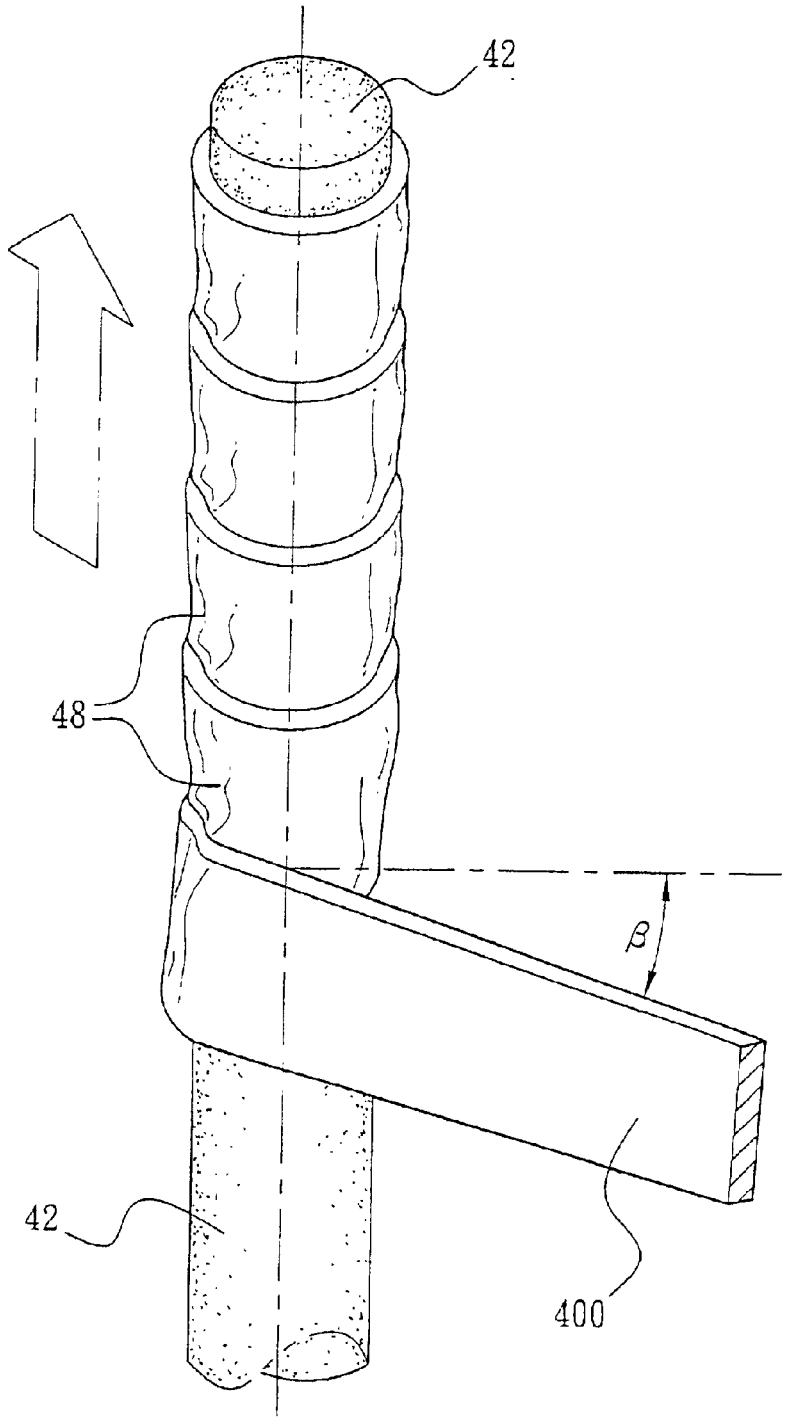
FIG. 5 (Prior Art)
FIG. 5 is a perspective view showing an undesired wrapping angle of tape with respect to wire of FIG. 4 caused uneven surface of wrapped tape.
Figure 6:
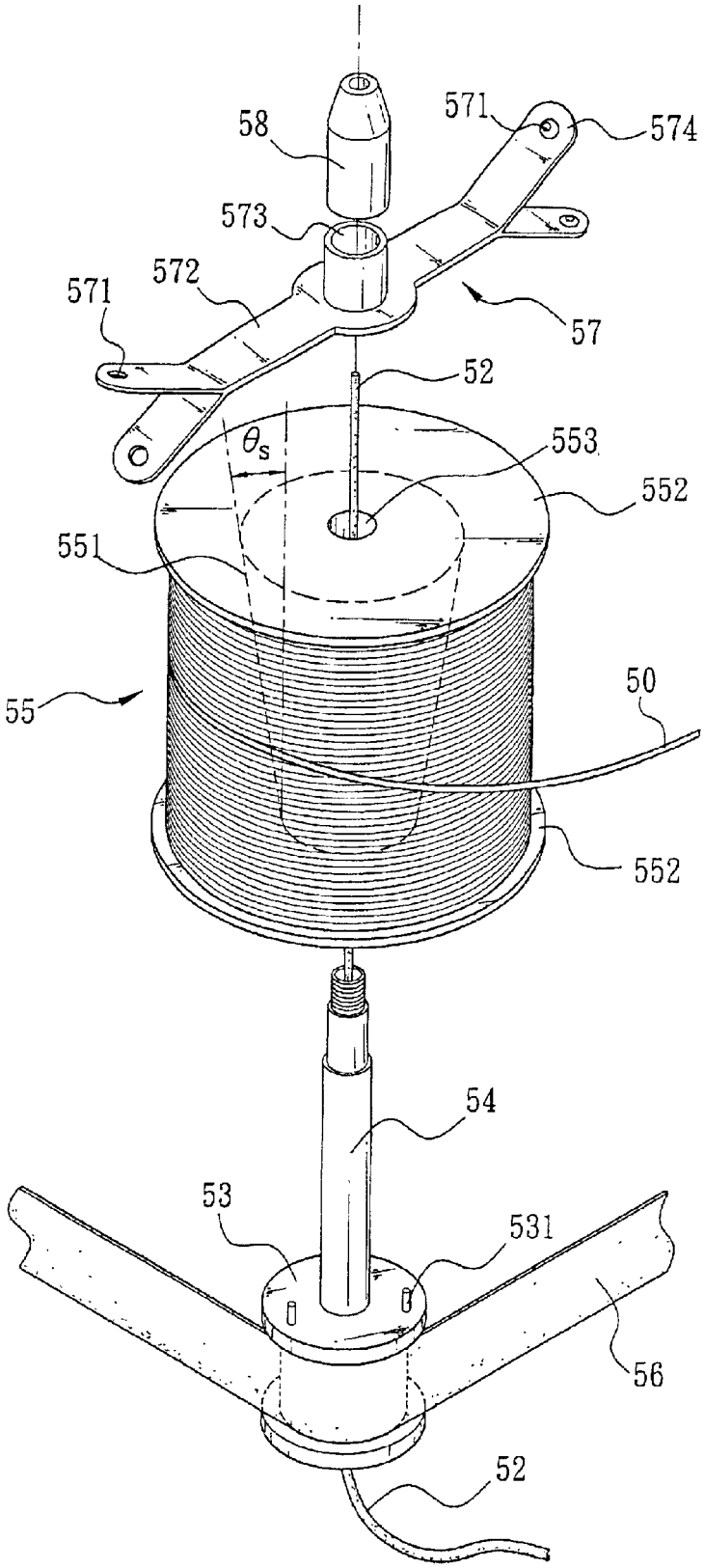
FIG. 6 is an exploded view of a spool device, belt, and flywheel incorporated in an apparatus for manufacturing wire according to the invention.
Figure 7:
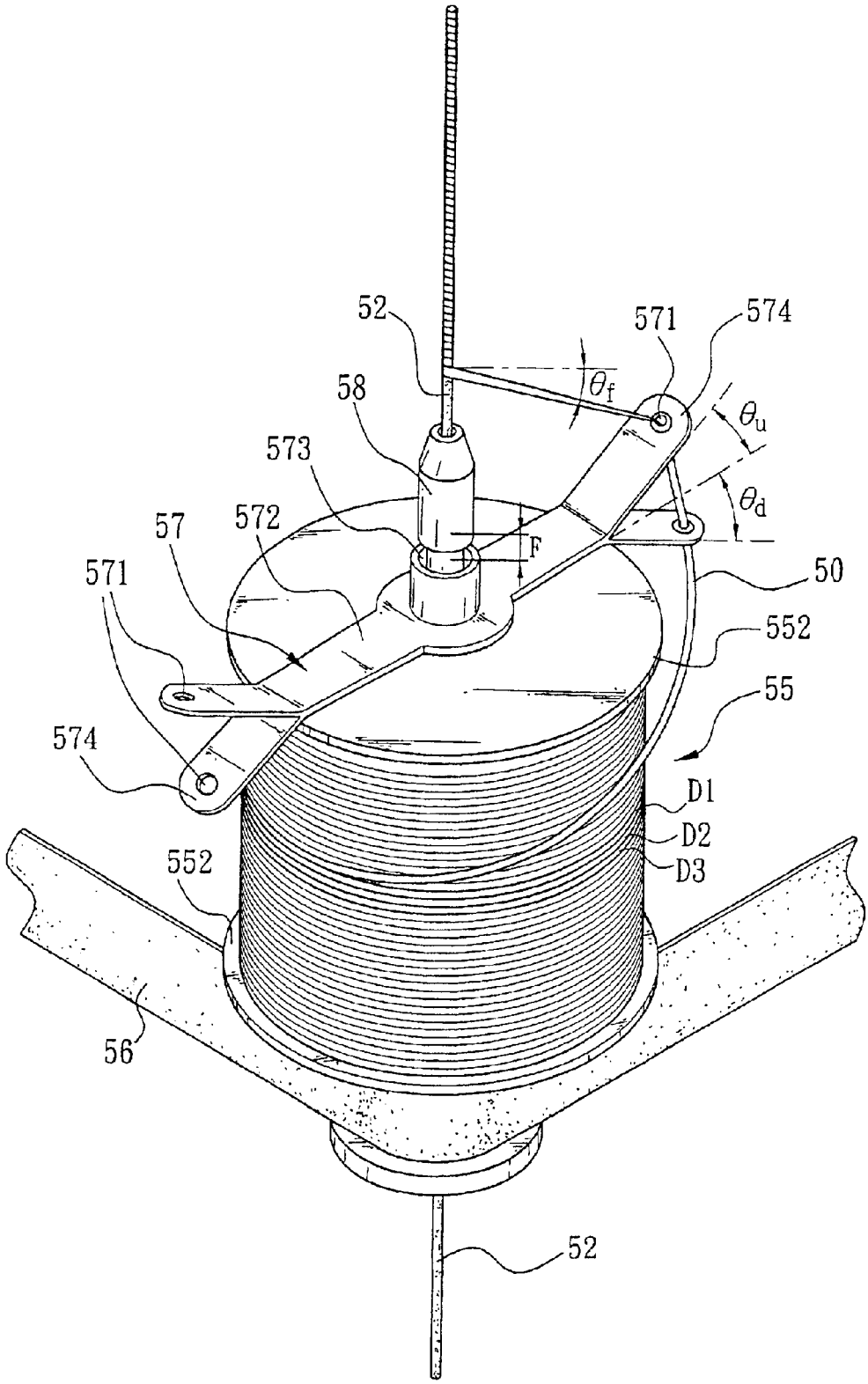
FIG. 7 is a perspective of the assembled FIG. 6 components.

Referring to FIGS. 6 and 7, the apparatus in accordance with the invention comprises a machine frame (not shown) provided thereon a hollow rotation seat 53, a belt 56, and a drive device (not shown) together with the rotation seat 53 and the belt 56 to form a chain drive. Further, an upright hollow shaft 54 is fixedly coupled to the center of the rotation seat 53. The rotation seat 53 rotates while the running of the belt 56 being activated by the drive device, the hollow shaft 54 rotates simultaneously. The apparatus further comprises a spool 55 having a hollow cylinder 553 as its rotation shaft and a rim 552 at either end. The tape 50 is wound on the cylinder 553 between the rims 552.

Note that the term "tape 50" used herein, is intended to generically define and indicate any continuous length material having features of flat, light, smooth (i.e., small friction), and flexible such as a color tape formed of Mylar or coated with metal film. While it is appreciated by those skilled in the art that any other suitable material having above features is still applicable without departing from the scope and spirit of the invention.

As shown in FIG. 6, while wrapping the tape 50 on at least one wire 52, the process thereof comprises the steps of putting the cylinder 553 on the hollow shaft 54 with the lower rim 552 of the spool 55 rested on at least one peg 531 (two are shown) on the top of the rotation seat 53 so that the spool 55 may rotate in synchronism with the rotation seat 53, threading the wire 52 through the rotation seat 53 and the hollow shaft 54 from the bottom of the rotation seat 53, pulling the wire 52 from the hollow shaft 54 above the spool 55 to one or more cylinders of a take-up device (not shown), wrapping one end of the tape 50 on the wire 52 above the hollow shaft 54, and activating the drive device and the take-up device to rotate the spool 55 and pull the wire 52, thereby unwinding the tape 50 from the spool 55 by utilizing the centrifugal force of rotation. As a result, the unwound tape 50 is continuously wrapped on the wire 52. Note that the term "wire 52" used herein is only an exemplary example. The wire 52 may be replaced by any other suitable wire formed of metal, non-metal material, or metal or non-metal wire surrounded with a certain medium such as one used in electrical wire, cable, power cord, or the like without departing from the scope and spirit of the invention.

In one preferred embodiment of the present invention, the tape 50 wound on the spool 55 has the features of flat, light, smooth, and flexible. Moreover, a predetermined tension should be applied on the tape 50, while winding tape 50 on the spool 55, to prevent the turns wound thereon from loosening due to small friction between the adjacent turns of the tape 50. The tension exerts thereon enables the tape 50 to be tightly wound on the spool 55. As shown in FIG. 7, however, while utilizing a method of the invention to wrap the tape 50 on the wire 52, the tension existing in the outmost turn of the tape D1 wound on the spool 55 will be released while the tape D1 being pulled to leave the spool 55 and will exert on the subsequent turns of tape D2, D3, and so on. As such, the turns D2, D3, and so on will tend to disengage from the spool 55 due to the very small friction among them, and entangle together to cause the turns D2 and D3 subject to breakage while a pulling force is exerted thereon. Hence, the angle enables the tape unwound from the spool to go from a lower position of the cylinder having a small diameter to a higher position of the cylinder having a large diameter while the tape being wrapped on the wire due to the centrifugal force of rotation in the wrapping process. For solving the above problem, the spool 55 is configured to have an inverted cone-shaped cylinder 551, of which the diameter of the top end of the cylinder is larger than the lower end to form the line from bottom periphery to top one of the cylinder 551 in an angle θs with respect to a vertical line. Hence, the angle θs enables the tape 50 unwound from the spool 55 to go from a lower position of the cylinder having a small diameter to a higher position of the cylinder having a large diameter while the tape 50 being wrapped on the wire 52 due to the centrifugal force of rotation in the wrapping process. This has the benefit of progressively releasing the tension existing in the turns of the tape 50 wound on the spool 55 and preventing the subsequent turns of the tape 50 from loosening from the spool 55, due to the suddenly released tension, and from entangling together. As a result, the tape 50 can be continuously, evenly, and securely wrapped on the upward feeding wire in a high speed operation. During the wrapping process, the wrapping angle of the tape with respect to the wire is always maintained as a fixed value. Hence, the tape is continuously and evenly wrapped on the upward feeding wire, wherein two adjacent turns of tape wrapped on the wire are partially overlapped. Then in an extrusion process, a transparent plastic material is extruded uniformly onto the surface of the wire wrapped with the tape to form a uniform protection layer outside. While bending the wire, the bending deformation of the wire will not cause the adjacent turns of the tape wrapped thereon disengaged from the wire, but remaining concealed on the wire. Thus, the high quality wire with a variety sparkling colors can be manufactured in a reliable process, especially in a mass production.

In addition, since there is no sufficient tension existing in the tape due to the floating phenomena caused by the air friction exerting thereon, the flat and light tape 50 can't be tightly wrapped on the wire 52 and may become loosened on the wire 52 in the wrapping process. In another preferred embodiment of the present invention, a flywheel 57 is put on the hollow shaft 54 on the top of the spool 55 in order to prevent the tape 50 from loosening. Also, a nut 58 is threadedly secured on the hollow shaft 54 above the flywheel 57 by a distance (i.e., tolerance) F. During the wrapping process, the wire 52 is passed through the hole of the nut 58. The flywheel 57 comprises a central hole 573 sleeved on the hollow shaft 54, two arms 572 extended outward in opposite directions, two bifurcated ends each having side pieces 574 wherein the upper side piece 574 is at an angle θu with respect to the arm 572 and the lower side piece 574 is at an angle θd with respect to the arm 572 respectively, and four eyes 571 each formed at the open end of the side piece 574.

In the another preferred embodiment, while wrapping the tape 50 on the wire 52, the process thereof comprises the step of threading the tape 50 through the lower and upper eyes 571 at one end of flywheel 57 sequentially prior to wrapping the tape 50 on the wire 52. The angles of θu and θd will produce an optimum angle θf of wrapping the tape 50 with respect to the wire 52. The angle θf will not cause the lower edge of the tape 50 to rub the nut 58. Moreover, the angles of θu and θd will not cause the tape 50 leaving the spool 55 to rub the edge of the rim 552. The wrapping process further comprises the final step of activating drive device and take-up device to rotate the spool 55 and thus the flywheel 57. A predetermined force is then exerted on the leaving tape 50 by the flywheel 57, such force is precisely calculated to cause the tape 50 to evenly wrap on the wire 52. In addition, the lengths and oblique angles of the side pieces 574 are designed to cause the tape 50 to continuously evenly wrap on the upward feeding wire 52 in an optimum angle with respect to the wire 52 wherein two adjacent turns of the tape 50 are partially overlapped. According to the above process, a reliable and high quality wire wrapped by a tape can be manufactured in a mass production.

In actually practicing the above embodiments to the wire manufacture, a variety of metal wires having diameter ranged from about 2 mm to about 6 mm or insulated electrical wires (at least one or more) were used. And, a flat, light, smooth and flexible tape such as a color tape formed of Mylar and coated with metal film having a thickness about 0.015 mm to about 0.035 mm and a width about 1 mm to about 3 mm was employed by the apparatus for wrapping the tape on the wire. The rotating speeds of drive and take-up devices, the weight and the length of the flywheel, the length of each side piece 574, and the angles θu and θd were designed to have optimum values through trial and error experiments. Also, θf, i.e., the wrapping angle with respect to the wire, was maintained at an angle about 8 to about 22 degrees. Further, two adjacent turns of tape were partially overlapped (i.e., about 20% to about 50% of the width of tape). During the wrapping process under the above conditions, the apparatus of the invention successfully finished a wire, continuously being wrapped with the tape, having a length about 30,000 meters without occurring any breakage on the tape. Moreover, the wire being wrapped with the tape has a smooth surface, i.e., without having any tape wrinkled. After the wrapping process, the wire being wrapped with the tape was delivered to an extrusion machine. In the extrusion machine, a transparent plastic material was extruded uniformly onto the surface of the wire to form a smooth protection layer outside the wire. After finishing the extrusion process, a wire characterized with a sparkling color in appearance was thus produced, wherein the adjacent turns of tape won't become disengaged even when a bending force exerting thereon. Most importantly, the electrical characteristics such as electromagnetic emissions shielding of the colorful electrical wire, cable or power cord is well maintained by the metal film coated on the tape, which was also approved after performing a number of tests and experiments.

While the invention has been described by means of specific embodiments, numerous modifications and variations could be made thereto by those skilled in the art without departing from the scope and spirit of the invention set forth in the claims.

What is claimed is:

1. An apparatus for manufacturing wire comprising:

a machine frame;

a hollow rotation seat on the machine frame being rotatably coupled to drive means;

an upright hollow shaft fixedly coupled to a center of the rotation seat so that the rotation seat, the drive means, and the follow shall are capable of rotating simultaneously; and a spool having a hollow cylinder as a rotation shaft being sleeved on the hollow shaft, a rim at either end, and a portion between said rims on which at least one flat, light, and smooth tape is to be wound, wherein the lower rim is secured on a top of the rotation seat and is shaped as an inverted cone having a first diameter at a top end of the portion on which the tape is to be wound that is larger than a second diameter at a lower end of the portion on which the tape is to be wound;

before wrapping the tape on at least one wire, the wire is threaded through the rotation seat and the hollow shaft from a bottom of the rotation seat, is pulled out from a top of the hollow shall to the take-up means, and then one end of the tape is wrapped on the wire above the hollow shaft; while activating the drive means and the take-up means to rotate the spool, the tape is unwound from the spool due to a centrifugal force of rotation, and continuously wrapped on the wire, wherein the rotation seat is coupled to the lower rim so that the spool rotates with the rotation seat.

2. The apparatus of claim 1, wherein the rotation seat comprises at least one peg on top of the rotation seat, the peg being fixed coupled to the lower rim so that the spool rotates in synchronism with the rotation seat.

3. The apparatus of claim 1, further comprising a flywheel including a central hole sleeved on the hollow shaft, two arms extended outward in opposite directions, two bifurcated ends each having an upper side piece and a lower side piece extending at angles with respect to the hollow shaft, and four eyes, a respective one of said eyes being positioned at an open end of each side piece; wherein one end of the tape is threaded through the lower and the upper eyes at one end of the flywheel, and then pulled to wrap on the wire.

4. The apparatus of claim 3, further comprising a nut secured on the hollow shaft above the flywheel by a tolerance and having a hole therein permitting the wire to pass through.

5. The apparatus of claim 3, wherein an angle of the upper side piece of the bifurcated ends with respect to the wire has a predetermined value for preventing the tape from rubbing the nut while leaving the eye on the upper side piece.

6. The apparatus of claim 3, wherein an angle of the lower side piece of the bifurcated ends has a predetermined value for preventing the tape from rubbing the rim while leaving the spool.

* * * * *